US005537935A

United States Patent [19]

Otaguchi et al.

[11] Patent Number: 5,537,935

[45] Date of Patent: Jul. 23, 1996

[54] STRINGER AND PALLET MAKING USE OF SUCH STRINGERS

[75] Inventors: Eiichi Otaguchi, Iwatsuki; Yasuo Yajima, Kadoma, both of Japan

[73] Assignees: Kabushiki Kaisha Tomoku, Tokyo; Kabushiki Kaisha RIC, Osaka-fu, both of Japan

[21] Appl. No.: 296,478

[22] Filed: Aug. 26, 1994

[30] Foreign Application Priority Data

Oct. 29, 1993 [JP] Japan ..... 5-058646 U
Mar. 10, 1994 [JP] Japan ..... 6-039802

[51] Int. Cl.[6] ..... B65D 19/00

[52] U.S. Cl. ..... 108/51.3; 108/56.1

[58] Field of Search ..... 108/51.1, 51.3, 108/56.1, 56.3

[56] References Cited

U.S. PATENT DOCUMENTS

| | | | |
|---|---|---|---|
| 2,997,266 | 8/1961 | Munroe | 108/51.3 |
| 3,000,603 | 9/1961 | Hemann | 108/51.3 |
| 3,464,371 | 9/1969 | Gifford | 108/51.1 X |
| 3,602,158 | 8/1971 | Skaggs | 108/51.3 |
| 3,628,469 | 12/1971 | Neitzke | 108/51.3 |
| 5,176,090 | 1/1993 | Roberts et al. | 108/51.3 |
| 5,184,558 | 2/1993 | Wozniacki | 108/51.3 |
| 5,222,444 | 6/1993 | Youell, Jr. et al. | 108/51.3 |
| 5,285,731 | 2/1994 | McIntyre | 108/51.3 |
| 5,329,861 | 7/1994 | McCarthy | 108/51.3 |

*Primary Examiner*—Peter M. Cuomo
*Assistant Examiner*—Janet M. Wilkens

[57] ABSTRACT

Stringers are fabricated in the form of a tube. The tube in cross section as viewed from its ends has a substantially square shape. Each stringer is fabricated from a plate material which includes a rectangular lower plate and two side plates separately connected to both edges of the rectangular lower plate through respective folding lines. There are a pair of first support plates partially cut out of the lower plate. The support plates are connected to the lower plate along folding lines. These folding lines are located inwardly from both ends of the lower plate and are in parallel with these ends. There are a pair of upper plates separately connected to distal edges of the side plates through respective folding lines. Also, there are second support plates separately connected to distal edges of the upper plates through respective folding lines. A pallet including an upper deck and a lower deck includes a plurality of the fabricated stringers. The stringers are fixed in position at both ends and an intermediate location of the pallet and between the upper and lower decks.

17 Claims, 13 Drawing Sheets

STRINGER AND PALLET MAKING USE OF SUCH STRINGERS

BACKGROUND OF THE INVENTION

1. Field of the Invention

The present invention relates to stringers and pallets making use of the stringers.

2. Description of the Background Art

Pallets used for carrying loads by a fork lift truck are generally formed by interposing long, prismatic stringers between an upper deck and a lower deck. The stringers are arranged at both ends and an intermediate site of such a pallet and between the upper and lower decks. An opening for inserting a fork therein is defined between the stringers adjacent to each other.

As such stringers, that have heretofore been used are those made of wood or a block-like plastic so as to withstand the weight of a load placed on a pallet. However, such stringers have disadvantages in that they are heavy and hence difficult to handle, and moreover they are expensive.

SUMMARY OF THE INVENTION

The present invention has been made with a view toward solving such disadvantages and has as an object the provision of a stringer which is light-weight and permits reduction in the cost of production, and a pallet making use of the improved stringers.

In order to achieve the above object, in an aspect of the present invention, there is thus provided a stringer fabricated from a plate material to form a tube having substantially square shape as viewed from the tube ends, comprising integrally a rectangular lower plate; side plates separately connected to both edges of the rectangular lower plate through respective folding lines; a pair of first support plates partially cut out of the lower plate by taking folding lines, which are defined at predetermined intervals inwardly from both ends of the lower plate in parallel with said both ends, as respective bases of the first support plates so as to partially separate from the lower plate; a pair of upper plates separately connected to distal edges of the side plates through respective folding lines; and second support plates separately connected to distal edges of the upper plates through respective folding lines, wherein the side plates are caused to vertically stand up face to face with each other along the respective folding lines, the first support plates are caused to vertically stand up face to face with each other along the respective folding lines in a state that the edges of each of the first support plates come into respect contact with the inner surfaces of the side plates, the upper plates are inwardly bent horizontally to the lower plate in directions opposite to each other, and the second support plates are bent downward at right angles with the respective upper plates, whereby first locking parts formed of cutouts provided in the first support plates are interlocked with second locking parts formed of cutouts provided in the second support plates corresponding to the first locking parts in a state perpendicular to each other. By this structure, the stringer can be fabricated with ease simply by inwardly bending or folding the individual plate parts along the respective folding lines, whereby fabricating operation can be simplified. The stringer can also reliably withstand a load applied from above by the side plates, first support plates and second support plates, while it can resist a load applied from a corner of a boundary between the side plate and the upper plate, or the like by supporting the side plates from the inside by the first support plates, whereby the strength and distortion resistance can be improved.

In the stringer according to the present invention, a part of the lower plate may also be left in the form of a flat plate between the first support plates when the first support plates are partially separated from the lower plate. The provision of the remaining part permits the widening of an adhesive area where the lower plate is bonded to a lower deck of a pallet, whereby the bond strength can be improved.

In the stringer according to the present invention, a pair of additional first support plates partially cut out of the lower plate by taking a pair of folding lines, which are defined on the remaining part in parallel with the respective bases of said first support plates, as respective bases of the additional first support plates and cutting the remaining part from the sides of both ends of the remaining part along edges of the remaining part so as to partially separate from the lower plate may be provided, whereby locking parts formed of cutouts provided in the additional first support plates may be interlocked with locking parts formed of cutouts provided in the second support plates corresponding to the locking parts formed in the additional first support plates in a state perpendicular to each other. In this stringer, since the additional first support plates are formed near both ends of the remaining part, an adhesive area where the lower plate is bonded to a lower deck of a pallet can be widened. In addition, the side plates can be more reliably supported by the first support plates and the additional first support plates, whereby the stringer may be provided as a stronger structure.

In the stringer according to the present invention, reinforcing pieces may be separately connected to both ends of the lower plate through respective folding lines to fold the reinforcing pieces so as to overlap the inner surface of the lower plate at the ends thereof. By this structure, when the stringer is fabricated, the reinforcing pieces overlap the lower plate, and the edges of each of the reinforcing pieces are brought into contact with its corresponding second support plate and side plate, and so the second support plate can be reliably kept in the standing state. When the reinforcing pieces are bonded to the lower plate, their overlapping can be surely kept.

In the stringer according to the present invention, reinforcing pieces may be separately connected to both ends of the side plates and both ends of the second support plates through respective folding lines to fold the reinforcing pieces so as to overlap their corresponding inner surfaces of the side plates and second support plates at the ends thereof. By this structure, when the stringer is fabricated, the reinforcing pieces overlap their corresponding inner surfaces of the side plates and second support plates, and the edges of each of the reinforcing pieces are brought into contact with its corresponding upper plate and the lower plate, and the thickness of the side plates is also increased, and so high strength can be achieved against a load applied from above. At this time, when the reinforcing pieces are bonded respectively to the side plates and the second support plates, their overlapping can be surely kept.

In the stringer according to the present invention, a pair of reinforcing plates may be separately connected to distal edges of the second support plates through respective folding lines to fold the reinforcing pieces so as to overlap in contact with the respective second support plates, whereby the locking parts formed of the cutouts provided in the first support plates may be interlocked with locking parts formed of cutouts provided in the second support plates and reinforcing plates corresponding to the locking parts formed in the first support plates in a state perpendicular to each other. By this structure, the thickness of the second support plates is increased, and so high strength can be achieved against a load applied from above.

In the stringer according to the present invention, block-like reinforcing materials may be inserted into spaces surrounded with the side plates, the upper plates, the first support plates and the second support plates. By this structure, the strength of the spaces surrounded with the side plates, the upper plates, the first support plates and the second support plates can be improved, and the stringer can hence be provided as a stronger structure.

In the stringer according to the present invention, a reinforcing material formed of a rectangular plate material and including a second lower plate in a shape that blocks off spaces surrounded with the side plates, the upper plates, the first support plates and the second support plates from the side of the lower plate, and a pair of tongues separately connected to both ends of the second lower plate through respective folding lines may be inserted into the spaces surrounded with the side plates, the upper plates, the first support plates and the second support plates by causing the tongues to stand up from the second lower plate so as to interlock locking parts formed of cutouts provided in the tongues with locking parts formed of cutouts provided in the second support plates corresponding to the locking parts formed in the tongues in a state perpendicular to each other. Even in this structure, the stringer can be provided as a stronger structure.

In another aspect of the present invention, there is also provided a pallet comprising an upper deck and a lower deck, both, in the form of a flat plate, and a plurality of the stringers as described above, said stringers being fixedly disposed at both ends and an intermediate site of the pallet and between the upper and lower decks. Since the stringers are in the form of a square tube, the positioning and bonding operations of the stringers are made easy. In addition, the stringers can be bonded at the whole surface of the upper plates and the lower surface of the lower plate, which remains where the first support plates are caused to stand up, and so an adhesive area is fully ensured, whereby the bond strength can be improved.

In the pallet according to the present invention, it may be preferable to separately insert reinforcing materials in the form of a square tube into spaces surrounded with the upper and lower decks and the side plates of the stringers. By this structure, areas relatively weak in flexural strength between the stringers can be reinforced with the reinforcing materials, and so the whole strength of the pallet can be improved.

In the pallet according to the present invention, end edges of both upper and lower decks may be bent at right angle in order for the bent parts to overlap each other, and one side plates of the stringers disposed at the ends of the pallet and between both decks may be fixedly bonded to the insides of the overlapped portions of the decks. By this structure, if a load is localized at an end part of the deck, the overlapped portions can prevent the pallet from being broken. In addition, both decks are fixedly bonded integrally with the stringers at the overlapped portions, and so the whole strength of the pallet can be more improved.

Other objects, features and advantages of the present invention will be readily appreciated from the preferred embodiments of the present invention, which will be described subsequently in detail with reference to the accompanying drawings.

BRIEF DESCRIPTION OF THE DRAWINGS

FIG. 2(*b*) is a perspective view illustrating the stringer of FIG. 2(*a*) with a lower plate turned up;

FIG. 2(*c*) is a cross-sectional view taken on line IIc—IIc in FIG. 2(*a*);

FIG. 5(*b*) illustrates another reinforcing material for stringers;

FIG. 6(*b*) is a cross-sectional view taken on line VIb—VIb in FIG. 6(*a*);

FIG. 6(*c*) is a development in plan illustrating the stringer of FIG. 6(*a*);

FIG. 7(*b*) is a cross-sectional view taken on line VIIb—VIIb in FIG. 7(*a*);

FIG. 7(*c*) is a development in plan illustrating the stringer of FIG. 7(*a*);

FIG. 8(*b*) is a development in plan illustrating the stringer of FIG. 8(*a*);

FIG. 9(*b*) is a development in plan illustrating the stringer of FIG. 9(*a*);

FIG. 10(*b*) is an development in plan illustrating the stringer of FIG. 10(*a*);

FIG. 11(*b*) is an exploded view in perspective of the stringer of FIG. 11(*a*);

FIG. 11(*c*) is a development in plan illustrating the reinforcing material in FIG. 11(*a*);

FIG. 12(*b*) is an development in plan illustrating the stringer of FIG. 12(*a*);

FIG. 13(*b*) is a development in plan illustrating the stringer of FIG. 13(*a*).

DETAILED DESCRIPTION OF THE PREFERRED EMBODIMENTS

Figure 1:
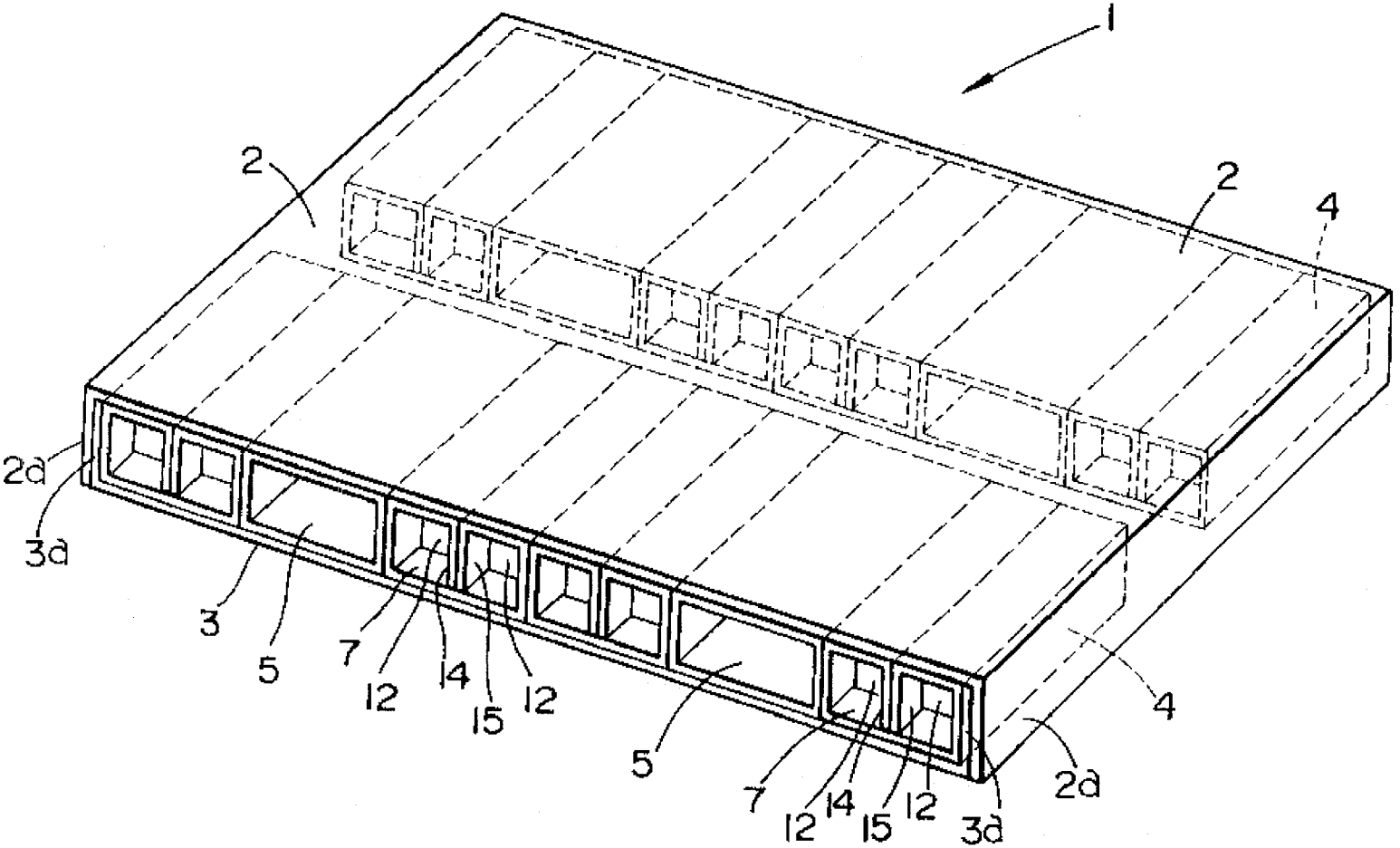
FIG. 1 is a perspective view illustrating a pallet according to an embodiment of the present invention.

The present invention will hereinafter be described as to the preferred embodiments with reference to the drawings. In the following, like reference characters designate like or corresponding parts throughout.

A pallet 1 according to an embodiment of the present invention is used for carrying loads by a fork lift truck, and as illustrated in FIG. 1, includes upper and lower decks 2, 3 formed with a square corrugated fiberboard, stringers 4 disposed at both ends and an intermediate site of the pallet 1 and between the upper and lower decks 2, 3, and reinforcing materials 5 interposed between the stringers 4.

Figure 2A:
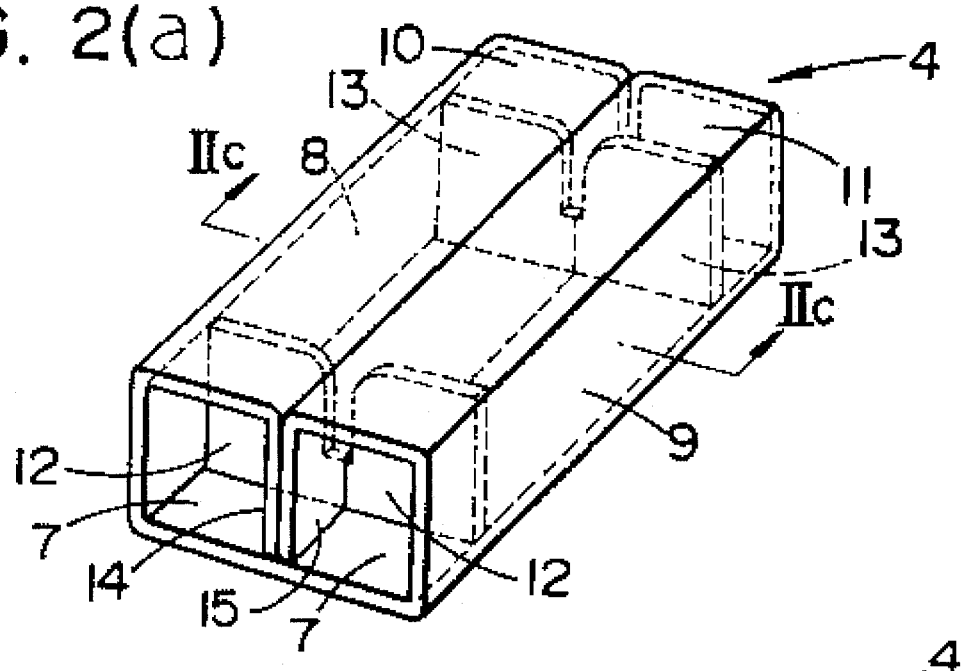
FIG. 2(*a*) is a perspective view of a stringer according to an embodiment of the present invention.
Figure 2B:
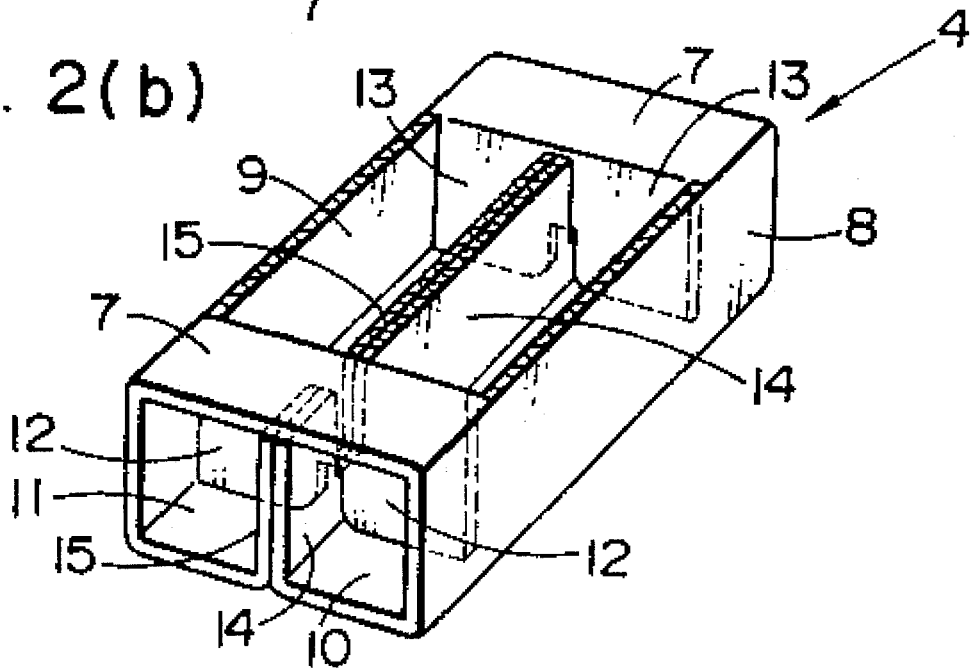
Figure 2C:
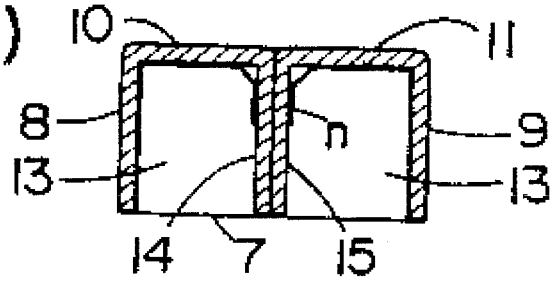
Figure 3:
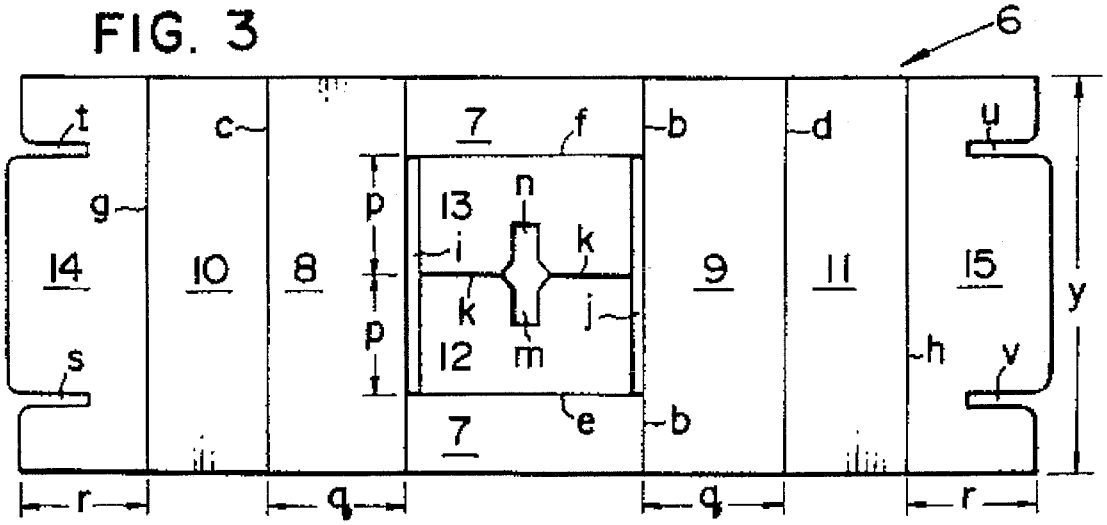
FIG. 3 is a development in plan illustrating the stringer.

As illustrated in FIGS. 2(*a*) and 2(*b*), the stringer 4, according to an embodiment is formed in a shape of a tube having a substantially square shape as viewed from its ends, by fabrication from a substantially rectangular corrugated fiberboard 6 illustrated in FIG. 3. Incidentally, FIG. 2(*b*) illustrates the stringer of FIG. 2(*a*) upside down.

The stringer 4 will now be described in detail. As illustrated in FIG. 3, the stringer 4 includes a rectangular lower plate 7, two side plates 8, 9 separately connected to both edges of the lower plate 7 through respective folding lines a, b and a pair of upper plates 10, 11 respectively connected to distal edges of the side plates 8, 9 through respective folding lines c. In addition, there are a pair of first support plates 12, 13 partially cut out of the lower plate 7 by taking folding lines e, f as respective bases of the first support plates 12, 13. Support plates 12 and 13 are partially separated from the lower plate 7. The second support plates 14, 15 are respectively connected to distal edges of the upper plates 10, 11 through respective folding lines g, h.

The first support plates 12, 13 are partially separable from the lower plate 7 by cuts i, j made between the folding lines e, f along both edges of the lower plate 7, and a cut k connecting both cuts i and j. The first support plates 12, 13 respectively have cutouts m, n made in the center of the cut k. The cutouts m, n are situated at the free edges of the first support plates 12, 13, respectively, when the first support plates 12, 13 are caused to stand up, thereby forming locking parts which interlock with the second support plates 14, 15 as will be described subsequently. The first support plates 12, 13 are formed in such a manner that the width p of each of the first support plates 12, 13, which is a height at the time it is caused to stand up, is equal to the width q of each of the side plates 8, 9, which is a height at the time it is caused to stand up.

The second support plates 14, 15 each have a width r approximately equal to the width q of the side plates 8, 9 and respectively have cutouts s, t and u, v made at their free edges. The cutouts s, v and t, u form locking parts which interlock with the cutouts m and n in the first support plates 12, 13, respectively, as will be described subsequently.

Figure 4A:
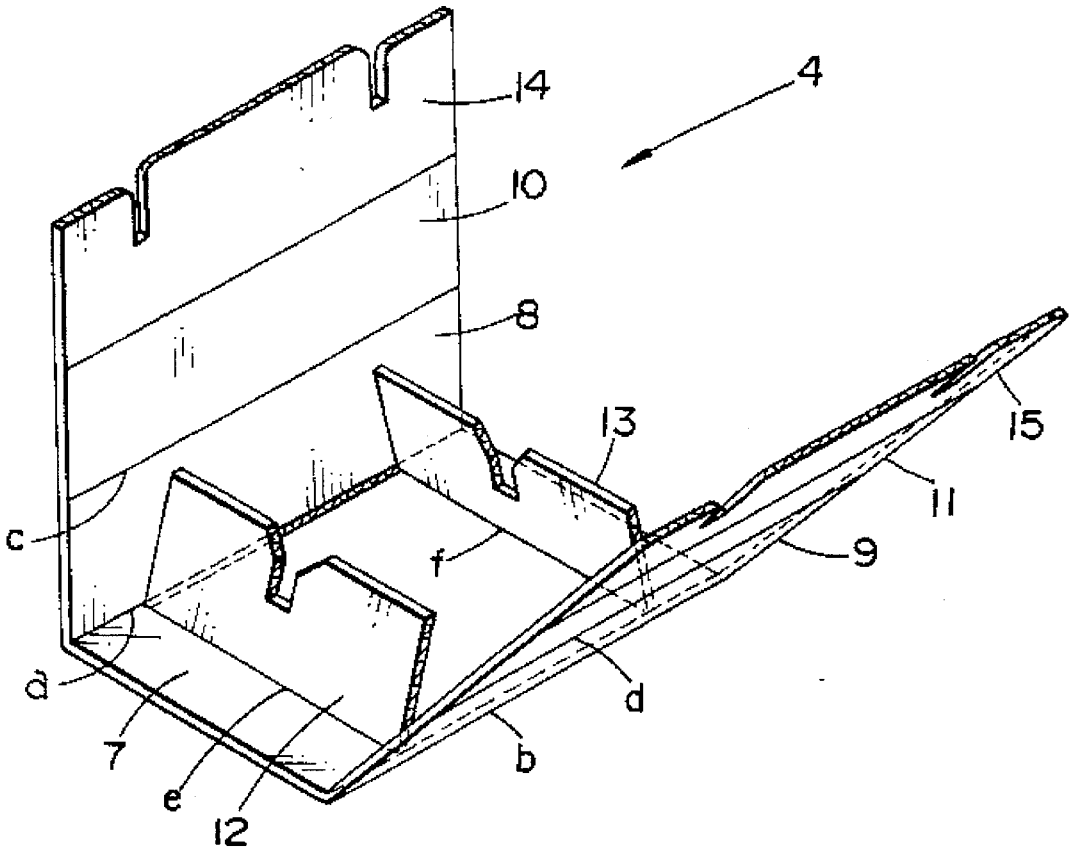
FIGS. 4(*a*) and 4(*b*) are perspective views illustrating how to fabricate the stringer.
Figure 4B:
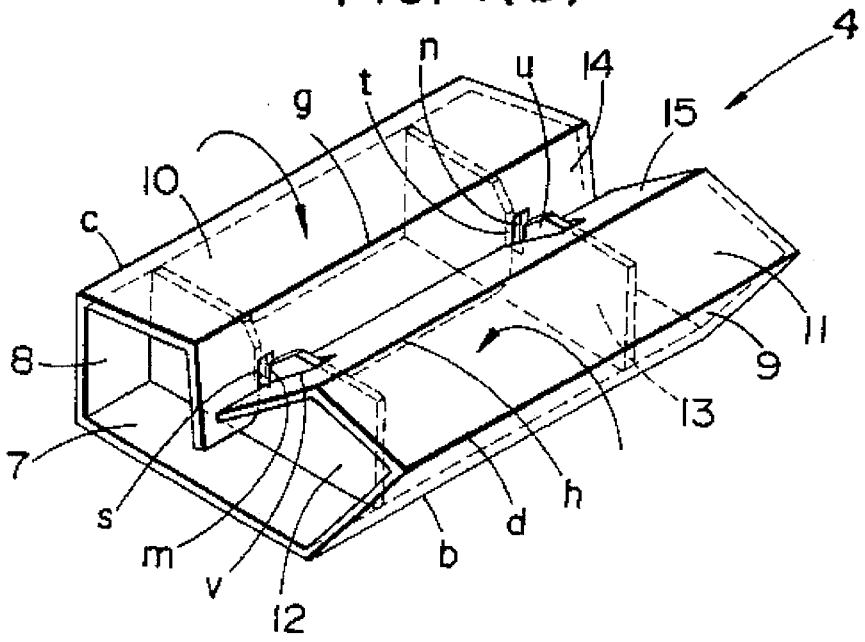

The fabricating process of the stringer 4 will be described. As illustrated in FIG. 4(*a*), the side plates 8, 9 are first caused to stand up along the respective folding lines a, b from a flat board shown in FIG. 3. The first support plates 12, 13 are then caused to stand up along the respective folding line e, f from the lower plate 7. As illustrated in FIG. 4(*b*), the upper plates 10, 11 are then bent along the respective folding lines c, d in directions that their distal edges face each other. At this time, the second support plates 14, 15 are bent downward along the respective folding lines g, h to bring the outer surfaces of the second support plates 14, 15 into contact with each other so as to make the surfaces of the upper plates 10, 11 level, and to bring the free edges of the second support plates 14, 15 into contact with the inner surface of the lower plate 7. At the same time, the cutouts s, t and u, v in the second support plates 14 and 15 form a pair of locking parts with the cutouts s and v, and t and u uniting with each other at the time the second support plates 14 and 15 are brought into contact with each other. Therefore, these locking parts are interlocked with their corresponding locking parts formed of the cutouts m, n provided in the first support plates 12, 13.

As described above, the stringer 4 is easy to fabricate. In addition, as illustrated in FIG. 2(*c*), the side plates 8, 9 can be reliably kept in the standing state by the engagement of the first support plates 12, 13 with the second support plates 14, 15. Moreover, the stringer 4 has a structure that can fully withstand a load applied from above by the side plates 8, 9, a pair of the first support plates 12, 13 and the overlapped second support plates 14, 15. After the second support plates 14, 15 are laminated by bonding to each other, the total fabricated structure of the stringer 4 reliably secured. In addition, there is an increase in the strength of the second support plates 14, 15. Further, if a load is applied from a corner of a boundary between the side plate 8, 9 and the upper plate 10, 11, the side plates 8, 9 are supported by the outer edges of the first support plates 12, 13, which come into contact with the side plates 8, 9, respectively, thereby keeping the side plates 8, 9 from falling. If the load is applied to the first support plates 12, 13, the first support plates 12, 13 are supported by the second support plates 14, 15 through the locking parts formed of the cutouts m, n provided at the free edges of thereof. Therefore, the stringer 4 can have sufficient strength to withstand the load applied from an oblique direction. Furthermore, when the pallet 1 is formed, the whole outer surfaces of the upper plates 10, 11 can be bonded to the upper deck 2 as illustrated in FIG. 2(*a*), while the flat portions formed near both ends of the lower plate 7 can be bonded to the lower deck 3 as illustrated in FIG. 2(*b*). Therefore, the adhesive area of the stringer 4 can be widened, whereby sufficient bond strength can be achieved.

In the pallet 1 according to this embodiment, as illustrated in FIG. 1, the reinforcing materials 5 are inserted into spaces surrounded with the upper and lower decks 2, 3, and the side plates 8, 9 of the individual stringers 4. Each of the reinforcing materials 5 is obtained by forming a corrugated fiberboard into a rectangular tube and bonding it up so as to permit the insertion of a fork of a fork lift truck. In the case of this kind of pallet 1, it is considered that no reinforcing material 5 is provided. However, the provision of such reinforcing materials permits the formation of a pallet 1 having a stronger structure. As illustrated in FIG. 1, end edges 2*a*, 2*a* of the upper deck 2 and their corresponding end edges 3*a*, 3*a* of the lower deck 3 may preferably overlap each other so as to bond to their corresponding side plates 8, 9 of the stringers disposed at both ends of the pallet 1. By this structure, the pallet 1 can be provided as a stronger structure.

With respect to the pallet 1 according to this embodiment, a corrugated fiberboard obtained by laminating a B-flute, an A-flute, an A-flute and a B-flute (both, prescribed in JIS) in that order is suitable for use as a material for the upper deck 2 and lower deck 3 though omitted in the drawing. The material for the decks is not limited to this corrugated fiberboard so far as it can give sufficient strength both decks 2, 3. For example, a two-layer corrugated fiberboard composed of an A-flute and a B-flute may be used as a material for the lower deck 3. Further, a corrugated fiberboard (not illustrated) of the same shape as the upper deck 2 may be laminated on the lower surface of the upper deck 2 to reinforce the upper deck 2. As a material for the stringer 4, the two-layer corrugated fiberboard composed of an A-flute and a B-flute is preferred. However, the material for the stringer 4 is not also limited to this, but corrugated fiberboards composed of two A-flute layers, three A-flute layers, two layers of a C-flute and a B-flute, or two C-flute layers may be suitably used.

Figure 5A:
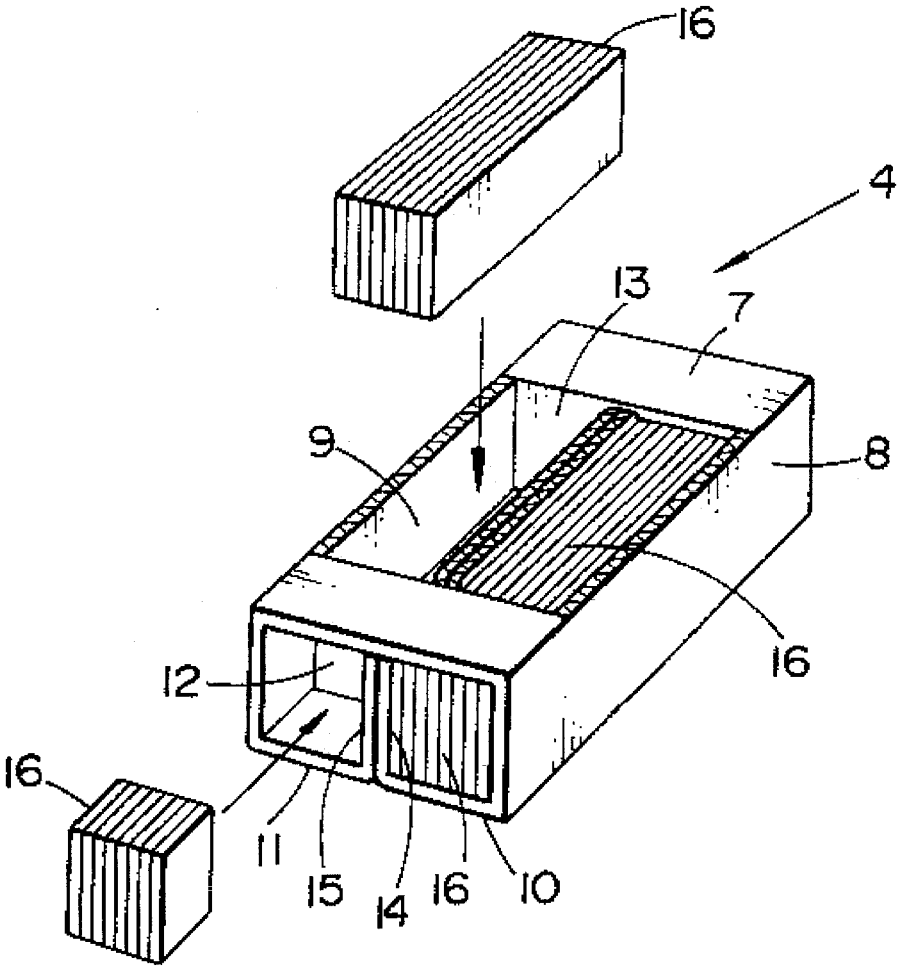
FIG. 5(*a*) illustrates a reinforcing material for stringers.
Figure 5B:
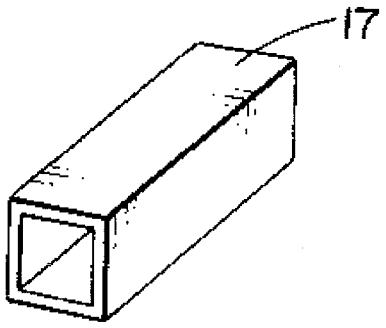

As illustrated in FIG. 5(*a*) with the lower plate 7 turned up, block-like reinforcing materials 16 may be provided in spaces surrounded with the side plates 8, 9, the upper plates 10, 11, the first support plates 12, 13 and the second support plates 14, 15. The reinforcing materials 16 may be either those obtained by laminating a plurality of corrugated fiberboards and forming the resulting laminate into blocks corresponding to the shapes of the respective spaces as illustrated in FIG. 5(*a*), or those obtained by forming a corrugated fiberboard into square tubes corresponding to the shapes of the respective spaces like a reinforcing material 17 illustrated in FIG. 5(*b*). By this structure, the stringer 4 can be provided as a stronger structure.

Figure 6A:
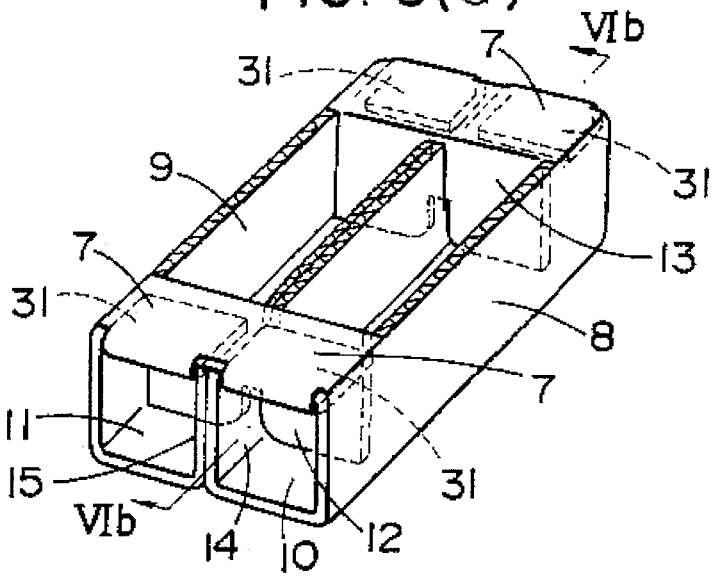
FIG. 6(*a*) is a perspective view of the stringer provided with reinforcing pieces.
Figure 6B:
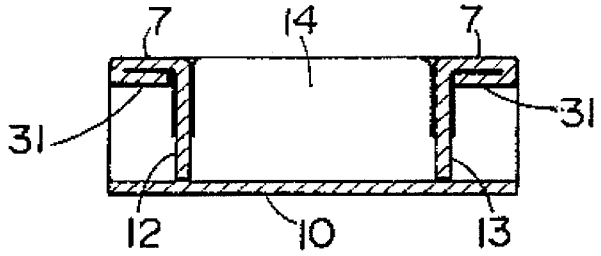
Figure 6C:
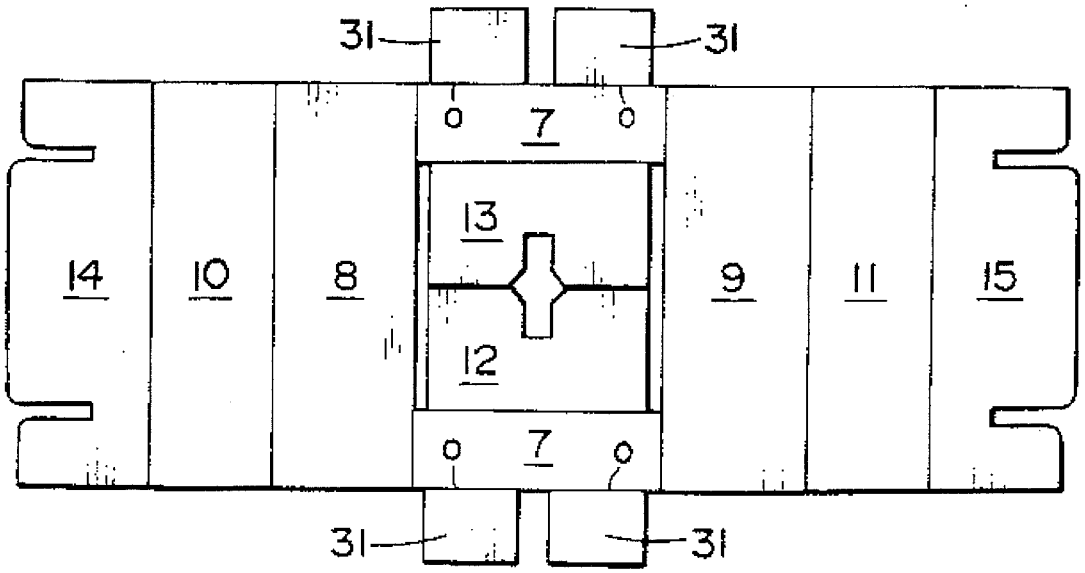
Figure 7A:
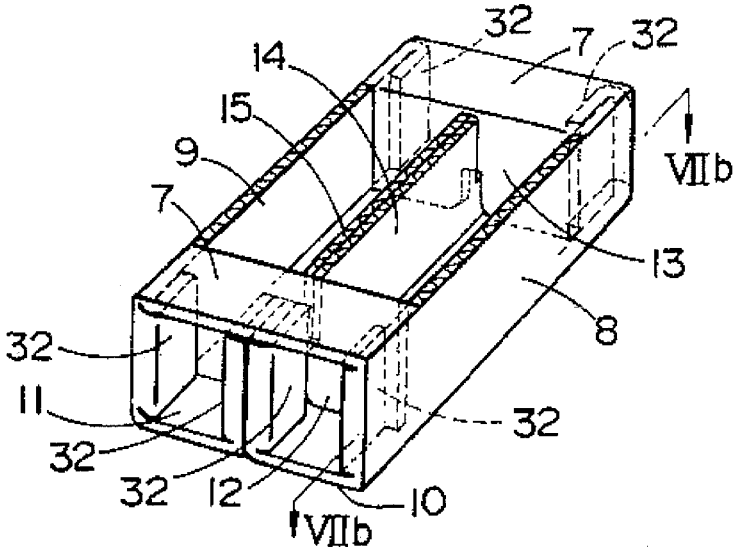
FIG. 7(*a*) is a perspective view illustrating the stringer provided with another reinforcing pieces with a lower plate turned up.
Figure 7B:
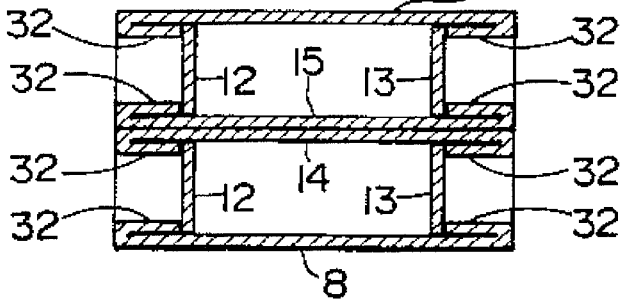
Figure 7C:
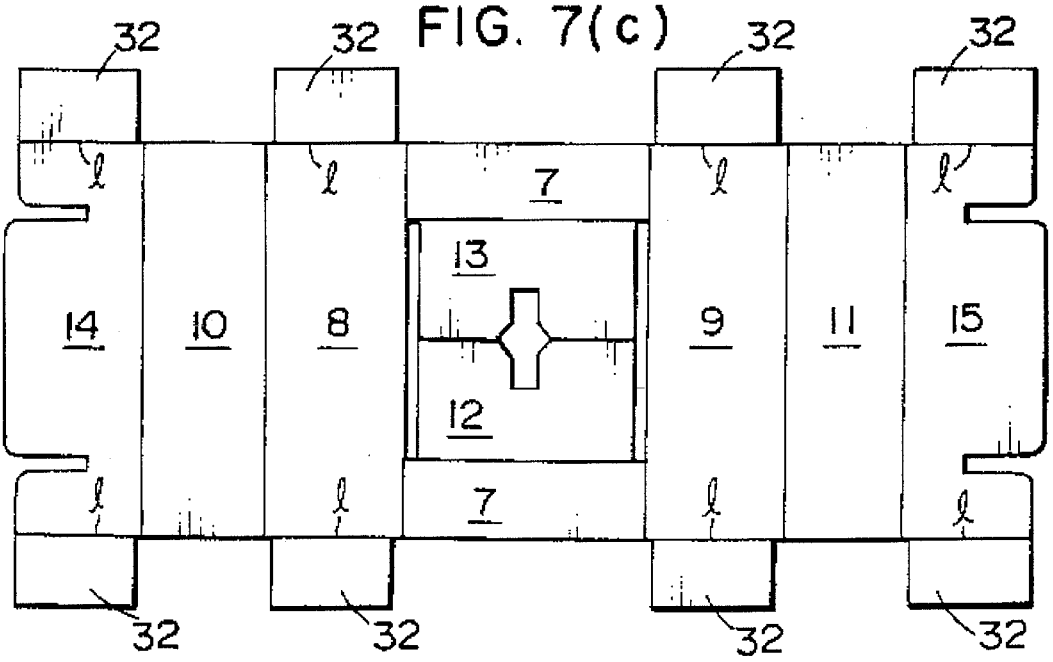

In this embodiment, in order to render the stringer 4 a stronger structure, it is preferable that the lower plate 7 be formed double as illustrated in FIG. 6(*a*) with the lower plate 7 turned up, or both side plates 8, 9 and second support plates 14, 15 be formed double as illustrated in FIG. 7(*a*) with the lower plate 7 turned up. In the case of the stringer 4 as illustrated in FIG. 6(*a*), reinforcing pieces 31 separately connected to both ends of the lower plate 7 through respective folding lines o as illustrated in FIG. 6(*c*) are folded to overlap the inner surface of the lower plate 7. At this time, when the reinforcing pieces 31 are bonded to the lower plate 7, their overlapping can be surely kept. By this structure, as illustrated in FIGS. 6(*a*) and 6(*b*), both edges of the respective reinforcing pieces 31 come into contact with the second support plates 14, 15 and the side plates 8, 9 to support them, to say nothing of the reinforcement of the lower plate 7, whereby the second support plates 14, 15 can be reliably kept in the standing state to impart sufficient strength to withstand a load applied from an oblique direction. In the case of the stringer 4 as illustrated in FIG. 7(*a*), reinforcing pieces 32 separately connected to both ends of the side plates 8, 9 and both ends of the second support plates 14, 15 through respective folding lines l as illustrated in FIG. 7(*c*) are folded to overlap their corresponding inner surfaces of the side plates 8,9 and second support plates 14, 15. At this time, when the reinforcing pieces 32 are bonded respectively to the side plates 8, 9 and the second support plates 14,15, their overlapping can be kept reliably as described above. By this structure, as illustrated in FIGS. 7(*a*) and 7(*b*), both edges of the respective reinforcing pieces 32 come into contact with the upper plates 10, 11 and the lower plate 7 to support them, whereby sufficient strength to withstand a load applied from above can be achieved. In addition, since the thickness of the side plates 8, 9 are also increased, the stringer 4 can be provided as a stronger structure.

Adding further, when such reinforcing pieces 31, 32 as described above are provided at all ends of the lower plate 7, the side plates 8, 9, the upper plates 10, 11 and the second support plates 14, 15 though shown in no drawing, the same effect as that attained by the reinforcing material 17 illustrated in FIG. 5(*b*) can be achieved. Moreover, the stringer 4 can be reinforced without preparing the reinforcing material 17 at the same time as its fabrication.

Figure 8:
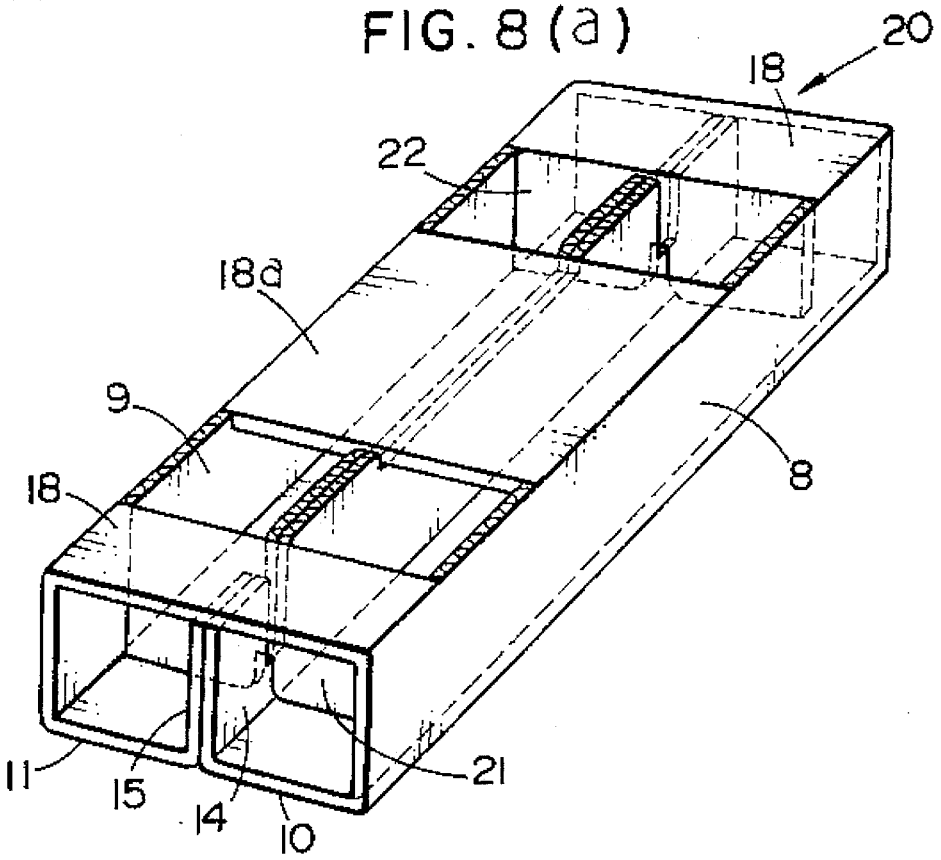
FIG. 8(*a*) is a perspective view illustrating a stringer according to another embodiment of the present invention with a lower plate turned up.
Figure 8:
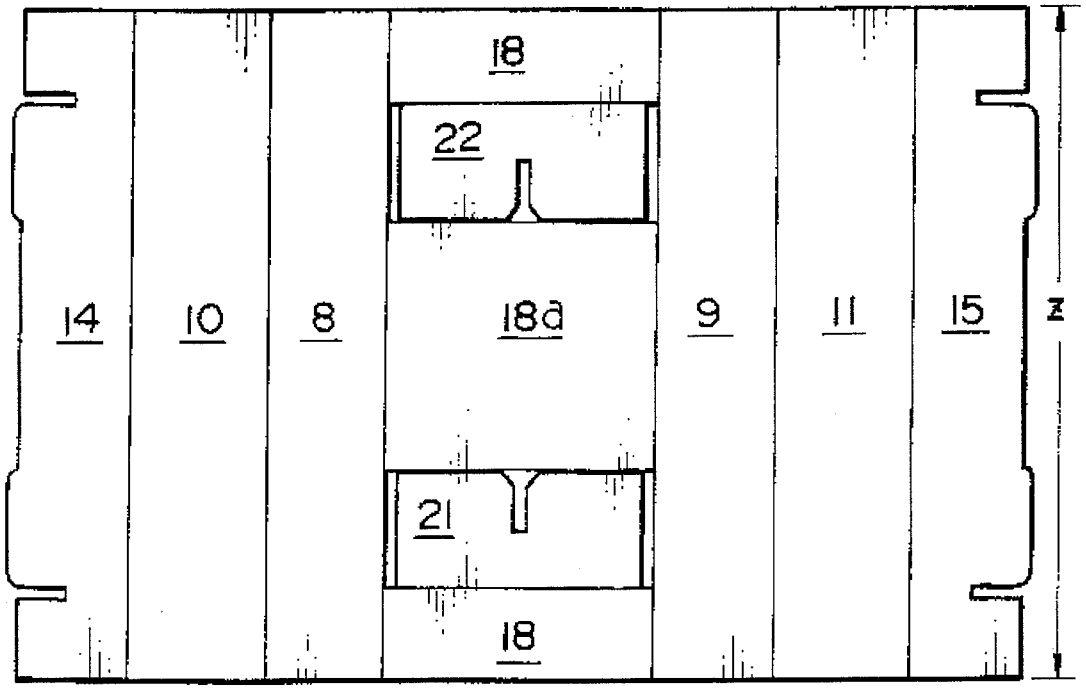

According to another embodiment, a stringer 20 in which a flat part 18*a* is formed in the center of a lower plate 18 as illustrated in FIG. 8(*a*) with the lower plate 18 turned up may be provided in place of the stringer 4 [see FIG. 2(*a*)] according to the first embodiment. As illustrated in FIG. 8(*b*), this flat part 18a is formed by making the width z of the stringer 20 shown in the developed state longer than the width y of the stringer 4 according to the first embodiment to provide an interval between a pair of first support plates 21, 22 formed in the lower plate 18. Therefore, when the first support plates 21, 22 are caused to stand up upon the fabrication of the stringer 20, a part of the lower plate 18 remains flat between the first support plates 21, 22. This remaining part, i.e., the flat part 18*a* formed in the center of the lower plate 18, permits widening of an adhesive area of the lower plate 18 to a lower deck, whereby bond strength can be improved.

Figure 9A:
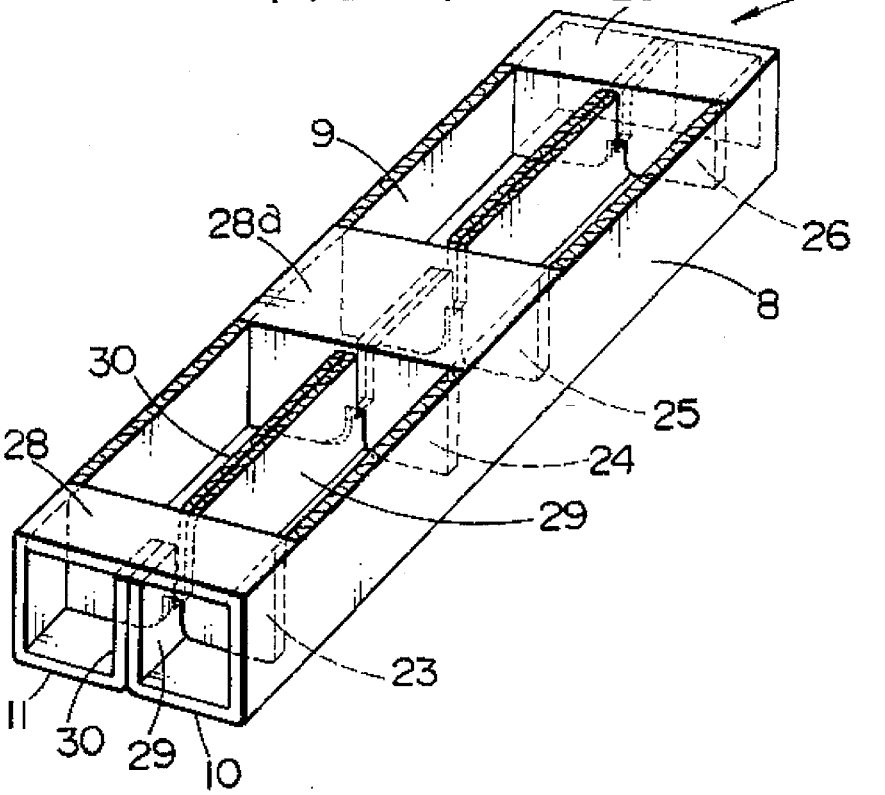
FIG. 9 (*a*) is a perspective view illustrating a stringer according to a further embodiment of the present invention with a lower plate turned up.
Figure 9B:
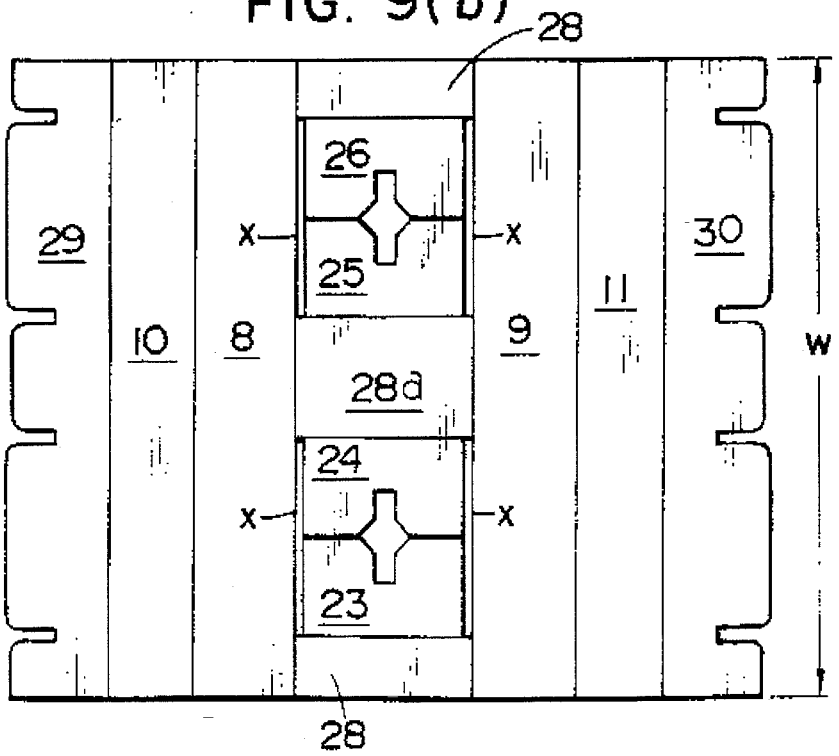

According to a further embodiment, a stringer 27 in which in addition to a pair of first support plates 23, 34, another pair of first support plates 25, 26 are formed as illustrated in FIGS. 9(*a*) and 9(*b*) may be provided in place of the stringer 4 [see FIG. 2(*a*)] according to the first embodiment. In this stringer 27, as illustrated in FIG. 9(*b*), the width w of the stringer 27 shown in the developed state is made longer than the width y of the stringer 4 according to the first embodiment to provide another pair of the first support plates 25, 26 at an interval from a pair of the first support plates 23, 24 formed in a lower plate 28. This stringer 27 has the same configuration as a case where two stringers 4 shown in FIG. 2(*a*) are longitudinally connected in series, or as a case where the flat part 18*a* situated in the center of the lower plate 18 of the stringer 20 shown in FIG. 8(*a*) is partially cut in opposite directions from both ends thereof along both edges thereof to form the first support plates 24 and 25 taking the ends of the flat parts 18*a* as free ends. By this structure, the stringer 27 can be provided as a structure that the first support plates 23, 24, 25, 26 are more strongly interlocked with second support plates 29, 30. This stringer 27 permits the formation of a pallet which is neither broken nor distorted. Incidentally, as illustrated in FIG. 9(*b*), the stringer 27 can be formed simply by making cuts x for forming plural pairs of the first support plates 23, 24, 25, 26 in the lower plate 28. Therefore, for example, the width w can be rendered still longer to form more first support plates (not illustrated). In other words, when the number of the first support plates partially separable from the lower plate 28 is increased, the stringer 27 can be formed in the same configuration as a case where a number of the stringers 4 shown in FIG. 2(*a*) are longitudinally connected in series. This permits the omission of an operation that a plurality of the stringers 4 are longitudinally arranged upon production of a pallet, and so a production process can be simplified by leaps and bounds.

As with the stringer 4 illustrated in FIG. 2(*a*), the stringers 20 and 27 illustrated in FIG. 8(*a*) and FIG. 9(*a*), respectively, may be reinforced by using the reinforcing materials 16 or 17 illustrated in FIG. 5(*a*) or 5(*b*) or providing the reinforcing pieces 31, 32 illustrated in FIGS. 6 and 7.

Figure 10A:
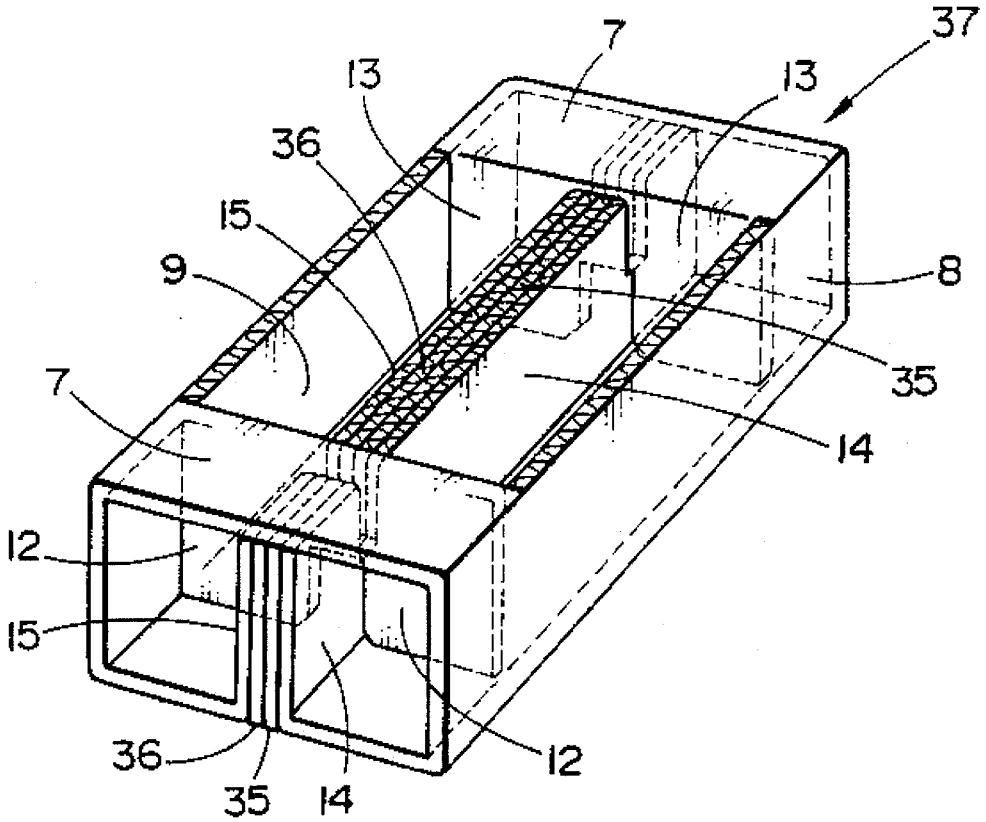
FIG. 10(*a*) is a perspective view illustrating a stringer according to a still further embodiment of the present invention with a lower plate turned up.
Figure 10B:
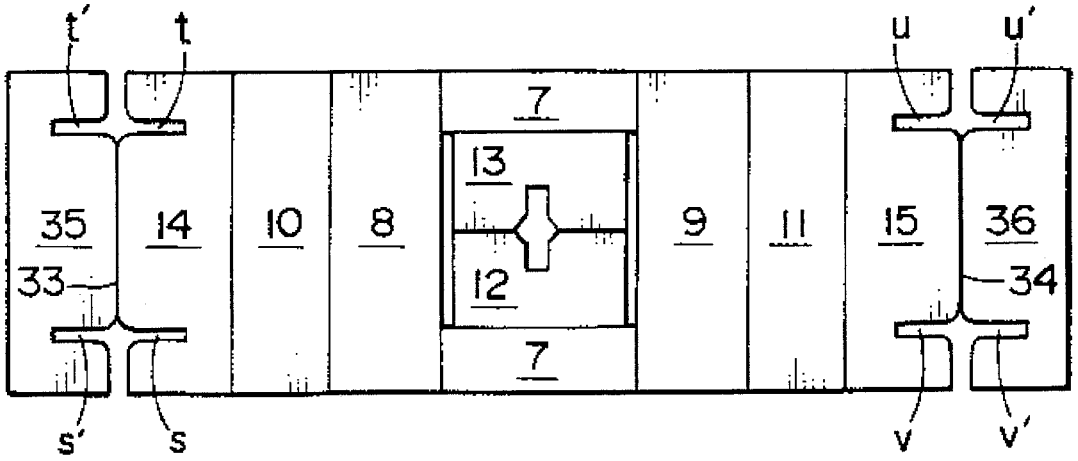

According to a still further embodiment, in order to render the stringer 4 [see FIG. 2(*a*)] according to the first embodiment a stronger structure, a pair of reinforcing plates 35, 36 may be respectively connected to distal edges of second support plates 14, 15 through respective folding lines 33, 34 as illustrated in FIGS. 10(*a*) and 10(*b*).

The reinforcing plates 35, 36 are folded so as to overlap the respective second support plates 14, 15, and the laminates are bent downward at right angles with respective upper plates 10, 11. At this time, the reinforcing plates 35, 36 are located in the center of the resulting stringer 37 in a state that they are held between both second support plates 14, 15 as illustrated in FIG. 10(*a*) with a lower plate 7 turned up. As illustrated in FIG. 10(*b*), the reinforcing plates 35 and 36 respectively have cutouts s', t' and u', v' which are interlocked with the cutouts m and n respectively made in first support plates 12 and 13 together with cutouts s, t and u, v respectively made in the second support plates 14 and 15. Therefore, the first support plates 12, 13 are interlocked with the reinforcing plates 35, 36 and the second support plates 14, 15 in a state perpendicular to each other. By this structure, in the stringer 37 illustrated in FIG. 10(*a*), the thickness of the second support plates 14, 15 is increased, and so sufficient strength to withstand a load applied from above can be achieved. As illustrated in FIG. 10(*b*), the folding lines 33, 34 are formed so as to be broken at the time the respective reinforcing plates 35, 36 are folded to overlap the second support plates 14, 15. Therefore, as illustrated in FIG. 10(*a*), the edges formed by breaking at the positions of the folding lines 33, 34 respectively situated between the second support plates 14, 15 and the reinforcing plates 35, 36 can be brought into stable contact with the lower plate 7. Incidentally, the folding lines 33, 34 may be formed only foldably without breaking.

Figure 11A:
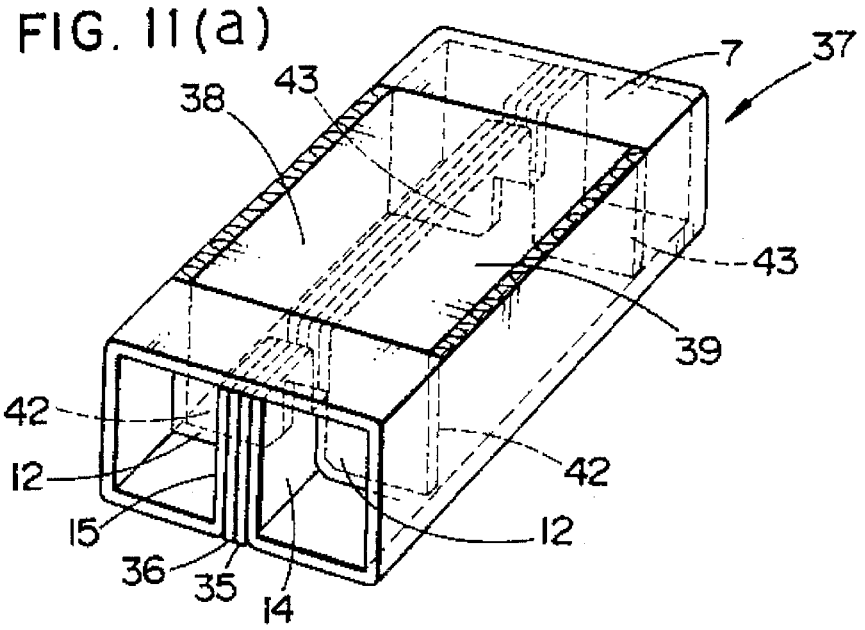
FIG. 11(*a*) is a perspective view illustrating the stringer provided with a further reinforcing material for stringers with a lower plate turned up.
Figure 11B:
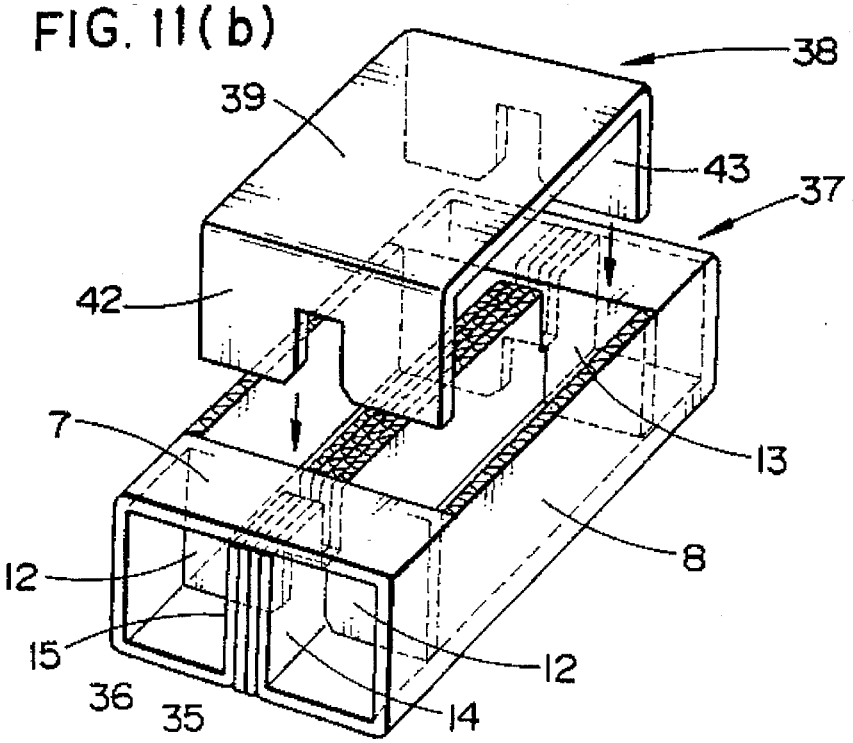
Figure 11C:
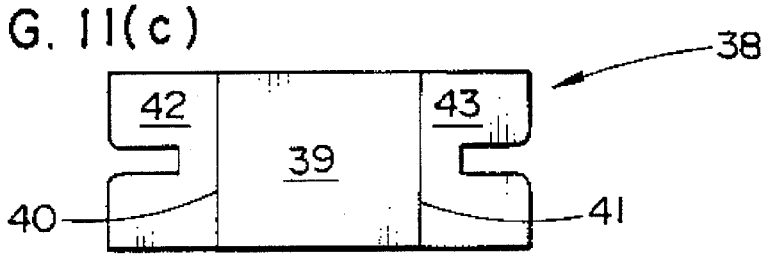

In the stringer 37 illustrated in FIG. 10(*a*), as illustrated in FIGS. 11(*a*) and 11(*b*), a reinforcing material 38 formed by bending a corrugated fiberboard may be provided in spaces surrounded with the side plates 8,9, the first support plates 12, 13 and the second support plates 14, 15. As illustrated in FIG. 11(*c*), the reinforcing material 38 is composed of a second lower plate 39 in the form of a rectangle and tongues 42, 43 separately connected to both ends of the second lower plate 39 through respective folding lines 40, 41. The reinforcing material 38 is inserted into the spaces in a state that the tongues 42, 43 are bent at a right angle with the second lower plate 39 so as to respectively overlap the first support plates 12, 13. By this structure, the stringer 37 can be provided as a stronger structure. Incidentally, the reinforcing material 38 may be inserted into spaces in the stringers 4, 20 and 27 according to the above-described embodiments. Alternatively, the reinforcing material 16 or 17 illustrated in FIG. 5(*a*) or 5(*b*) may be inserted into the spaces in the stringer 37 illustrated in FIG. 10(*a*). By these structures, the individual stringers 4, 20, 27 and 37 can also be provided as stronger structures. Besides, the reinforcing pieces 31, 32 illustrated in FIGS. 6 and 7 may also be provided on the stringer 37.

Figure 12A:
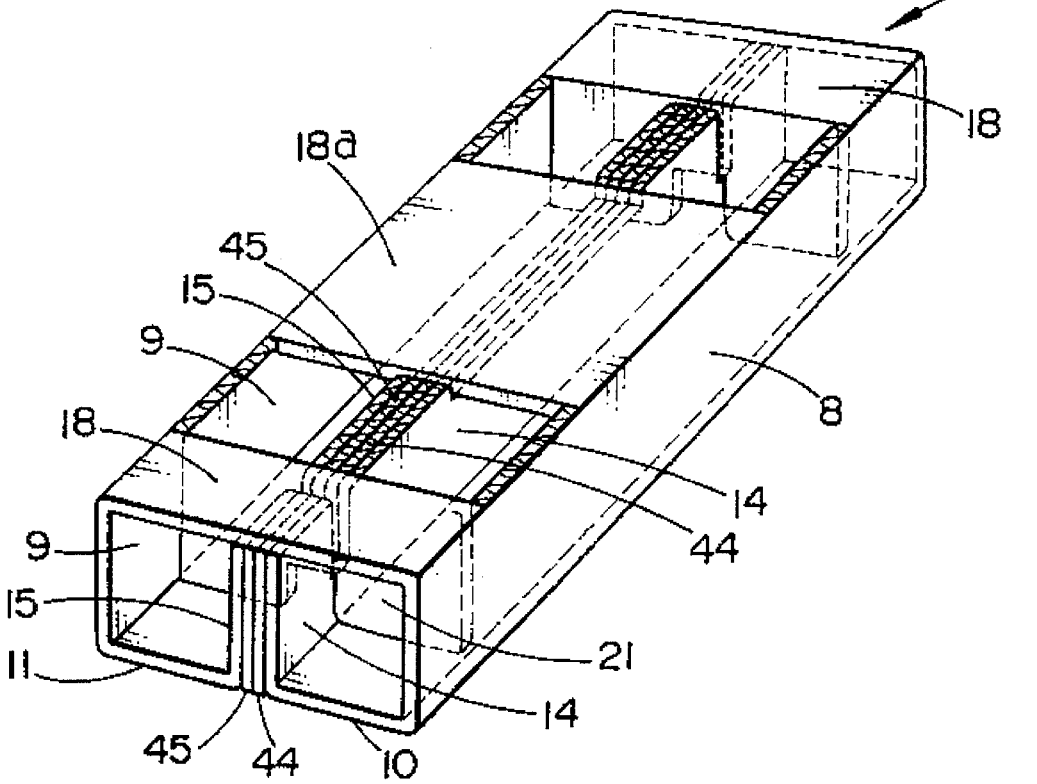
FIG. 12(*a*) is a perspective view illustrating a stringer according to a yet still further embodiment of the present invention with a lower plate turned up.
Figure 12B:
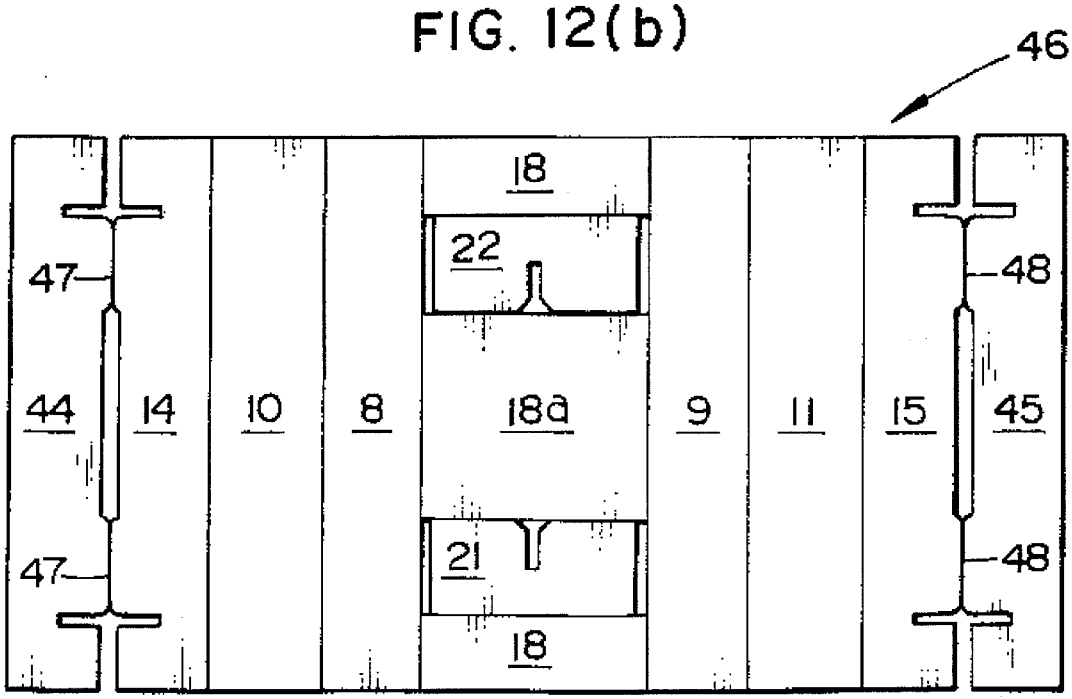

According to a yet still further embodiment, as illustrated in FIG. 12(*a*) with a lower plate 18 turned up, there may be provided a stringer 46 in which reinforcing plates 44, 45 are provided on the stringer 20 [see FIG. 8(*a*)]. More specifically, as illustrated in FIG. 12(*b*), a pair of the reinforcing plates 44, 45 are respectively connected to distal edges of second support plates 14, 15 through respective folding lines 47, 48 easy to be broken. The reinforcing plates 44, 45 are folded so as to overlap the respective second support plates 14, 15, and the laminates are bent downward at right angles with respective upper plates 10, 11. Therefore, the reinforcing plates 44, 45 are located in the center of the stringer 46 in a state that they are held between both second support plates 14, 15 as illustrated in FIG. 12(*a*). Both second support plates 14 and 15 and both reinforcing plates 44 and 45 also strongly support a flat part 18*a* situated in the center of a lower plate 18, thereby permitting stable bonding of the flat part 18*a* and the lower plate 18 to a lower deck of a pallet.

Figure 13A:
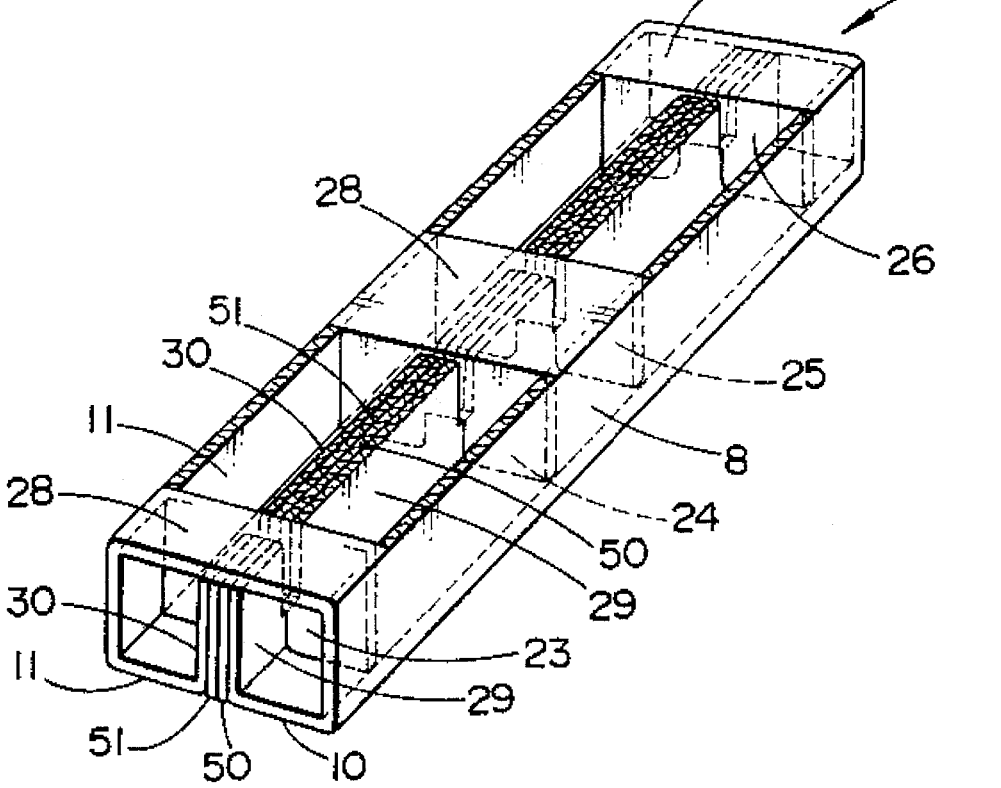
FIG. 13(*a*) is a perspective view illustrating a stringer according to a yet still further embodiment of the present invention with a lower plate turned up.
Figure 13B:
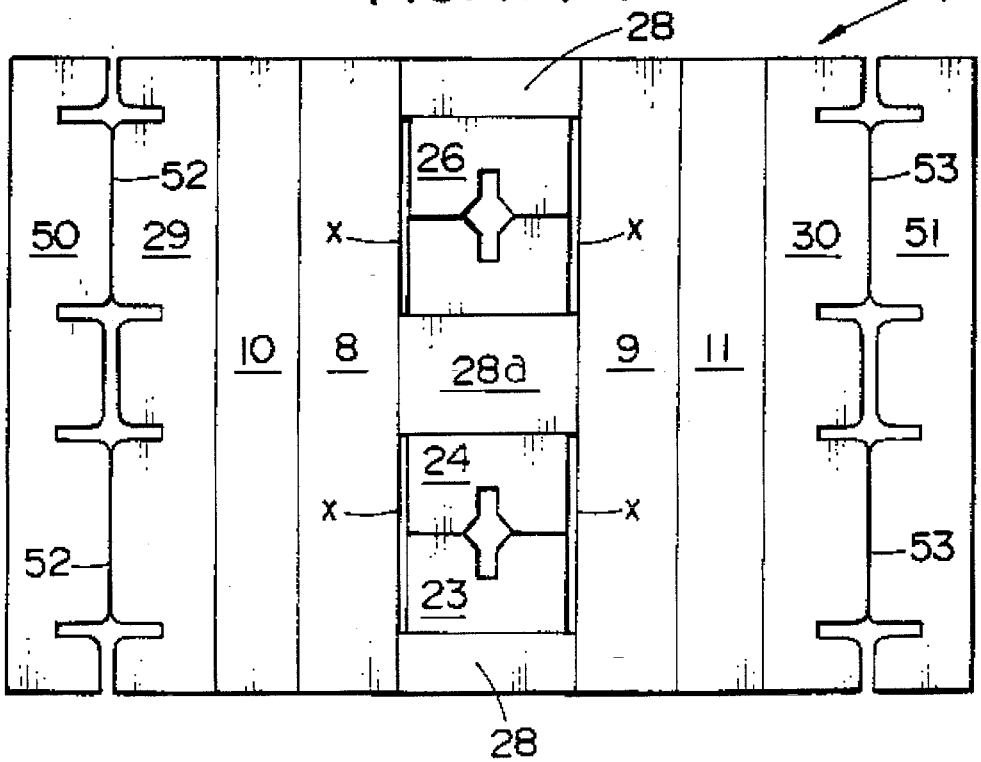

According to a yet still further embodiment, as illustrated in FIG. 13(*a*) with a lower plate 28 turned up, there may be provided a stringer 49 in which reinforcing plates 50, 51 are provided on the stringer 27 [see FIG. 9(*a*)]. As with the above-described embodiments, the reinforcing plates 50, 51 are respectively connected to distal edges of second support plates 29, 30 through respective folding lines 52, 53 easy to be broken as illustrated in FIG. 13(*b*). The stringer 49 has, in addition to a pair of first support plates 23, 24, another pair of first support plates 25, 26. In addition to such a strong structure, the thickness of the second support plates 29, 30 is increased, and so the stringer 49 can be provided as a still stronger structure.

Even in the stringers 46 and 49 illustrated in FIGS. 12(*a*) and 13(*a*), respectively, it goes without saying that any of the reinforcing materials 16, 17 and 38 illustrated in FIGS. 5(*a*), 5(*b*) and 11(*c*), respectively, may be used, or the reinforcing pieces 31, 32 illustrated in FIGS. 6 and 7 may be provided, thereby permitting the provision of the stringers 46 and 49 as far stronger structures.

Incidentally, it goes without saying that the parts making use of corrugated fiberboards in the above-described embodiments are not limited to those made of corrugated fiberboards, but may be changed to those making use of, for example, synthetic resin sheets or plates.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A stringer fabricated in the form of a tube having a substantially square shape as viewed from its ends, fabricated from a plate material comprising integrally:

a rectangular lower plate;

side plates separately connected to both edges of the rectangular lower plate through respective folding lines;

a pair of first support plates partially cut out of the rectangular lower plate and connected thereto by folding lines, the folding lines spaced inwardly from and in parallel with both ends of the rectangular lower plate, the folding lines forming base portions of the first support plates;

a pair of upper plates separately connected to distal edges of the side plates through respective folding lines; and second support plates separately connected to distal edges of the upper plates through respective folding lines, wherein the side plates are caused to vertically stand up face to face with each other along the respective folding lines, the first support plates are caused to vertically stand up face to face with each other along the respective folding lines in a state that the edges of each of the first support plates come into respective contact with the inner surfaces of the side plates, the upper plates are inwardly bent horizontally to the lower plate in directions opposite to each other, and the second support plates are bent downward at right angles with the respective upper plates, whereby first locking parts formed of cutouts provided in the first support plates are interlocked with second locking parts formed of cutouts provided in the second support plates corresponding to the first locking parts in a state perpendicular to each other; and reinforcing pieces separately connected to both ends of the side plates and both ends of the second support plates through respective folding lines allowing folding of the reinforcing pieces so as to overlap their corresponding inner surfaces of the side plates and second support plates at the ends thereof.

2. The stringer according to claim 1, wherein a part of the lower plate is left in the form of a flat plate between the first support plates when the first support plates are partially separated from the lower plate.

3. The stringer according to claim 2, wherein a pair of additional first support plates partially cut out of the lower plate are provided wherein portions of the lower plate are cut to form sides of the additional first support plates so as to partially separate the additional first support plates from the lower plate, whereby locking parts formed of cutouts provided in the additional first support plates are interlocked with locking parts formed of cutouts provided in the second support plates corresponding to the locking parts formed in the additional first support plates in a state perpendicular to each other.

4. The stringer according to any one of claims 1 to 3, wherein block-like reinforcing materials are inserted into spaces surrounded with the side plates, the upper plates, the first support plates and the second support plates.

5. The stringer according to any one of claims 1 to 3, wherein a reinforcing material formed of a rectangular plate material and including a second lower plate in a shape that blocks off spaces surrounded with the side plates, the upper plates, the first support plates and the second support plates from the side of the lower plate, and a pair of tongues separately connected to both ends of the second lower plate through respective folding lines are inserted into the spaces surrounded with the side plates, the upper plates, the first support plates and the second support plates by causing the tongues to stand up from the second lower plate so as to interlock locking parts formed of cutouts provided in the tongues with locking parts formed of cutouts provided in the second support plates corresponding to the locking parts formed in the tongues in a state perpendicular to each other.

6. A stringer fabricated in the form of a tube having a substantially square shape as viewed from its ends, fabricated from a plate material comprising integrally:

a rectangular lower plate;

side plates separately connected to both edges of the rectangular lower plate through respective folding lines;

a pair of first support plates partially cut out of the rectangular lower plate and connected thereto by folding lines, the folding lines spaced inwardly from and in parallel with both ends of the rectangular lower plate, the folding lines forming base portions of the first support plates;

a pair of upper plates separately connected to distal edges of the side plates through respective folding lines; and second support plates separately connected to distal edges of the upper plates through respective folding lines, wherein the side plates are caused to vertically stand up face to face with each other along the respective folding lines, the first support plates are caused to vertically stand up face to face with each other along the respective folding lines in a state that the edges of each of the first support plates come into respective contact with the inner surfaces of the side plates, the upper plates are inwardly bent horizontally to the lower plate in directions opposite to each other, and the second support plates are bent downward at right angles with the respective upper plates, whereby first locking parts formed of cutouts provided in the first support plates are interlocked with second locking parts formed of cutouts provided in the second support plates corresponding to the first locking parts in a state perpendicular to each other, a pair of reinforcing plates are separately connected to distal edges of the second support plates through respective folding lines to fold the reinforcing pieces so as to overlap in contact with the respective second support plates, whereby the locking parts formed of the cutouts provided in the first support plates are interlocked with locking parts formed of cutouts provided in the second support plates and the reinforcing plates corresponding to the locking parts formed in the first support plates in a state perpendicular to each other.

7. The stringer according to claim 6, wherein a part of the lower plate is left in the form of a flat plate between the first support plates when the first support plates are partially separated from the lower plate.

8. The stringer according to claim 6, wherein a pair of additional first support plates partially cut out of the lower plate are provided wherein portions of the lower plate are cut to form sides of the additional first support plates so as to partially separate the additional first support plates from the lower plate, whereby locking parts formed of cutouts provided in the additional first support plates are interlocked with locking parts formed of cutouts provided in the second support plates corresponding to the locking parts formed in the additional first support plates in a state perpendicular to each other.

9. A pallet comprising:

an upper deck and a lower deck, both, in the form of a flat plate, and a plurality of stringers fabricated in the form of tubes having a substantially square shape as viewed from its ends, fabricated from plate material and fixedly disposed at both ends and an intermediate site of the pallet and between the upper and lower decks, each of said stringers including integrally:

a rectangular lower plate;

side plates separately connected to both edges of the rectangular lower plate through respective folding lines;

a pair of first support plates partially cut out of the rectangular lower plate and connected thereto by folding lines, the folding lines spaced inwardly from and in parallel with both ends of the rectangular lower plate, the folding lines forming base portions of the first support plates;

a pair of upper plates separately connected to distal edges of the side plates through respective folding lines;

second support plates separately connected to distal edges of the upper plates through respective folding lines, wherein the side plates are caused to vertically stand up face to face with each other along the respective folding lines, the first support plates are caused to vertically stand up face to face with each other along the respective folding lines in a state that the edges of each of the first support plates come into respective contact with the inner surfaces of the side plates, the upper plates are inwardly bent horizontally to the lower plate in directions opposite to each other, and the second support plates are bent downward at right angles with the respective upper plates, whereby first locking parts formed of cutouts provided in the first support plates are interlocked with second locking parts formed of cutouts provided in the second support plates corresponding to the first locking parts in a state perpendicular to each other; and wherein in the stringer, reinforcing pieces are separately connected to both ends of the side plates and both ends of the second support plates through respective folding lines to fold the reinforcing pieces so as to overlap their corresponding inner surfaces of the side plates and second support plates at the ends thereof.

10. The pallet according to claim 9, wherein in the stringer, a part of the lower plate is left in the form of a flat plate between the first support plates when the first support plates are partially separated from the lower plate.

11. The pallet according to claim 9, wherein in the stringer, a pair of additional first support plates partially cut out of the lower plate are provided wherein portions of the lower plate are cut to form sides of the additional first support plates so as to partially separate the additional first support plates from the lower plate, whereby locking parts formed of cutouts provided in the additional first support plates are interlocked with locking parts formed of cutouts provided in the second support plates corresponding to the locking parts formed in the additional first support plates in a state perpendicular to each other.

12. The pallet according to any one of claims 9 to 11, wherein in the stringer, reinforcing pieces are separately connected to both ends of the lower plate through respective folding lines to fold the reinforcing pieces so as to overlap the inner surface of the lower plate at the ends thereof.

13. The pallet according to any one of claims 9 to 11, wherein in the stringer, block-like reinforcing materials are inserted into spaces surrounded with the side plates, the upper plates, the first support plates and the second support plates.

14. The pallet according to any one of claims 9 to 11, wherein in the stringer, a reinforcing material formed of a rectangular plate material and including a second lower plate in a shape that blocks off spaces surrounded with the side plates, the upper plates, the first support plates and the second support plates from the side of the lower plate, and a pair of tongues separately connected to both ends of the second lower plate through respective folding lines are inserted into the spaces surrounded with the side plates, the upper plates, the first support plates and the second support plates by causing the tongues to stand up from the second lower plate so as to interlock locking parts formed of cutouts provided in the tongues with locking parts formed of cutouts provided in the second support plates corresponding to the locking parts formed in the tongues in a state perpendicular to each other.

15. The pallet according to any one of claims 9 to 11, wherein reinforcing materials in the form of a square tube are separately inserted into spaces surrounded with the upper and lower decks and the side plates of the stringers.

16. The pallet according to any one of claims 9 to 11, wherein end edges of both upper and lower decks are bent at right angle in order for the bent parts to overlap each other, and side plates of the stringers disposed at the ends of the pallet and between both decks are fixedly bonded to the insides of the overlapped portions of the decks.

17. A pallet comprising:

an upper deck and a lower deck, both, in the form of a flat plate, and a plurality of stringers fabricated in the form of tubes having a substantially square shape as viewed from its ends, fabricated from plate material and fixedly disposed at both ends and an intermediate site of the pallet and between the upper and lower decks, each of said stringers including integrally:

a rectangular lower plate;

side plates separately connected to both edges of the rectangular lower plate through respective folding lines;

a pair of first support plates partially cut out of the rectangular lower plate and connected thereto by folding lines, the folding lines spaced inwardly from and in parallel with both ends of the rectangular lower plate, the folding lines forming bases of the first support plates;

a pair of upper plates separately connected to distal edges of the side plates through respective folding lines;

second support plates separately connected to distal edges of the upper plates through respective folding lines, wherein the side plates are caused to vertically stand up face to face with each other along the respective folding lines, the first support plates are caused to vertically stand up face to face with each other along the respective folding lines in a state that the edges of each of the first support plates come into respective contact with the inner surfaces of the side plates, the upper plates are inwardly bent horizontally to the lower plate in directions opposite to each other, and the second support plates are bent downward at right angles with the respective upper plates, whereby first locking parts formed of cutouts provided in the first support plates are interlocked with second locking parts formed of cutouts provided in the second support plates corresponding to the first locking parts in a state perpendicular to each other; and wherein in the stringer, a pair of reinforcing plates are separately connected to distal edges of the second support plates through respective folding lines to fold the reinforcing pieces so as to overlap in contact with the respective second support plates, whereby the locking parts formed of the cutouts provided in the first support plates are interlocked with locking parts formed of cutouts provided in the second support plates and the reinforcing plates corresponding to the locking parts formed in the first support plates in a state perpendicular to each other.

* * * * *